United States Patent [19]

Gryctko

[11] 3,958,204

[45] May 18, 1976

[54] FUSED GFI UNIT

[75] Inventor: Carl E. Gryctko, Haddon Heights, N.J.

[73] Assignee: I-T-E Imperial Corporation, Spring House, Pa.

[22] Filed: Jan. 27, 1975

[21] Appl. No.: 544,191

[52] U.S. Cl. ..... 337/6; 317/18 D; 335/18

[51] Int. Cl.² ..... H01H 83/20; H01H 71/40

[58] Field of Search ..... 337/6, 4, 11; 317/18 D; 335/18

[56] References Cited

UNITED STATES PATENTS

| | | | |
|---|---|---|---|
| 3,440,579 | 4/1969 | Smith | 335/18 |
| 3,493,815 | 2/1970 | Hurtle | 317/18 D |
| 3,579,038 | 5/1971 | Franklin et al. | 317/18 D |
| 3,636,482 | 1/1972 | Edmunds | 317/18 D |
| 3,796,980 | 3/1974 | Ellsworth | 337/6 |

*Primary Examiner*—Harold Broome

*Attorney, Agent, or Firm*—Ostrolenk, Faber, Gerb & Soffen

[57] ABSTRACT

A fused GFI unit for manually controlling the application of electrical power to a utilization device while automatically protecting the device and personnel associated therewith from electrical hazards, includes a switch plate unit have an insulated handle for controlling mechanical current interrupting means. Fuse receptacle means is provided in series connection with the switch pole to protect the GFI unit and the power lines against overcurrent hazards. A ground fault detector operates an actuating member in mechanical cooperation with the latched portion of the switch mechanism to enable current interruption by the switch pole in the event an unbalanced current flow is produced in one of a pair of power lines by a personnel hazard. A compact sectionalized structure encasing the switch, the fuse receptacle means and the GFI detector results.

5 Claims, 7 Drawing Figures

FUSED GFI UNIT

BACKGROUND OF THE INVENTION

The present invention relates to power switching mechanisms and more particularly relates to a novel mechanical power switching device having dual-mode equipment and personnel protection means in a compact assembly.

It is known to series connect a mechanical power control switch and fuse device to protect a power utilization mechanism and the power lines thereto from the adverse thermal effects of an overcurrent caused by a short circuit therein or a faulty utilization device. This arrangement does not provide protection to personnel against an electrical shock hazard. Recently there has been a significant interest in ground fault protective means to provide such personnel protection. Ground fault protection is applicable to both consumer and light industrial circuits where relatively large and costly circuit breakers having thermal and/or electromechanical overcurrent protection arrangements are not utilized. In circuits where a fuse must suffice for overcurrent protection, it is nevertheless desirable to provide a compact and relatively inexpensive power control unit including ground fault detection means cooperating with the mechanical switch to protect against personnel shock hazards.

SUMMARY OF THE INVENTION

In accordance with the instant invention, a molded housing includes fuse receptacle means in electrical series connection with a single pole mechanical power switch which includes a pair of cooperating separable contacts and operating means for causing the engagement and disengagement of the contacts. Ground fault detecting means having a movable member in close cooperation with the contact cooperating means for causing the separation of the contacts in response to a current unbalance in either of a pair of current carrying lines, comprising a circuit in which the contacts, fuse and ground fault detector are connected.

Typically, a ground fault will be detected whenever an additional line current flow is caused by a high impedance path, such as a human body or an improper line insulation portion, being applied between one of the load energizing lines and earth ground. The ground fault detector includes a differential transformer to detect this current imbalance and also includes an electromagnetically actuated member that is energized by the operation of the ground fault detection circuitry when the detected current unbalance exceeds a predetermined limit. At this time the armature of the electromagnet in the ground fault detector portion is actuated in the tripping direction of the switching mechanism trip latch. An actuating member connected to this armature extends into the switching mechanism portion to release the trip latch and release springbiased separable contacts, thereby interrupting the flow of circuit current to both the utilization device and the object causing the undesirable leakage current path to earth-ground.

In one embodiment of this invention, the fuse receptacle means, the mechanical power switch, and the ground fault detector portions of the unit are stack positioned to for a unitary structure of generally rectangular shape for mounting in an electrical wiring enclosure.

In a second embodiment of this invention, the switch means and the ground fault detector means are maintained in a side-by-side arrangement with the fuse receptacle means. The substantially square frontal area resulting from this arrangement is particularly adapted for use with certain classes of existing electrical equipment enclosures.

Accordingly, it is a primary object of the instant invention to provide a novel unit combining a mechanical power switch with fuse receptacle means and a ground fault detector to actuate the switch means.

It is a further object to provide a novel construction for mechanically coordinating the operation of the ground fault detecting means and the mechanical power switch means.

It is another object of the instant invention to provide such a unit which is compact and mountable in existing electrical equipment enclosures.

These as well as other objects of the instant invention will become readily apparent after reading the following detailed description of the accompanying drawings.

DETAILED DESCRIPTION OF THE INVENTION

Figures 1, 2, 5, 6, 7:
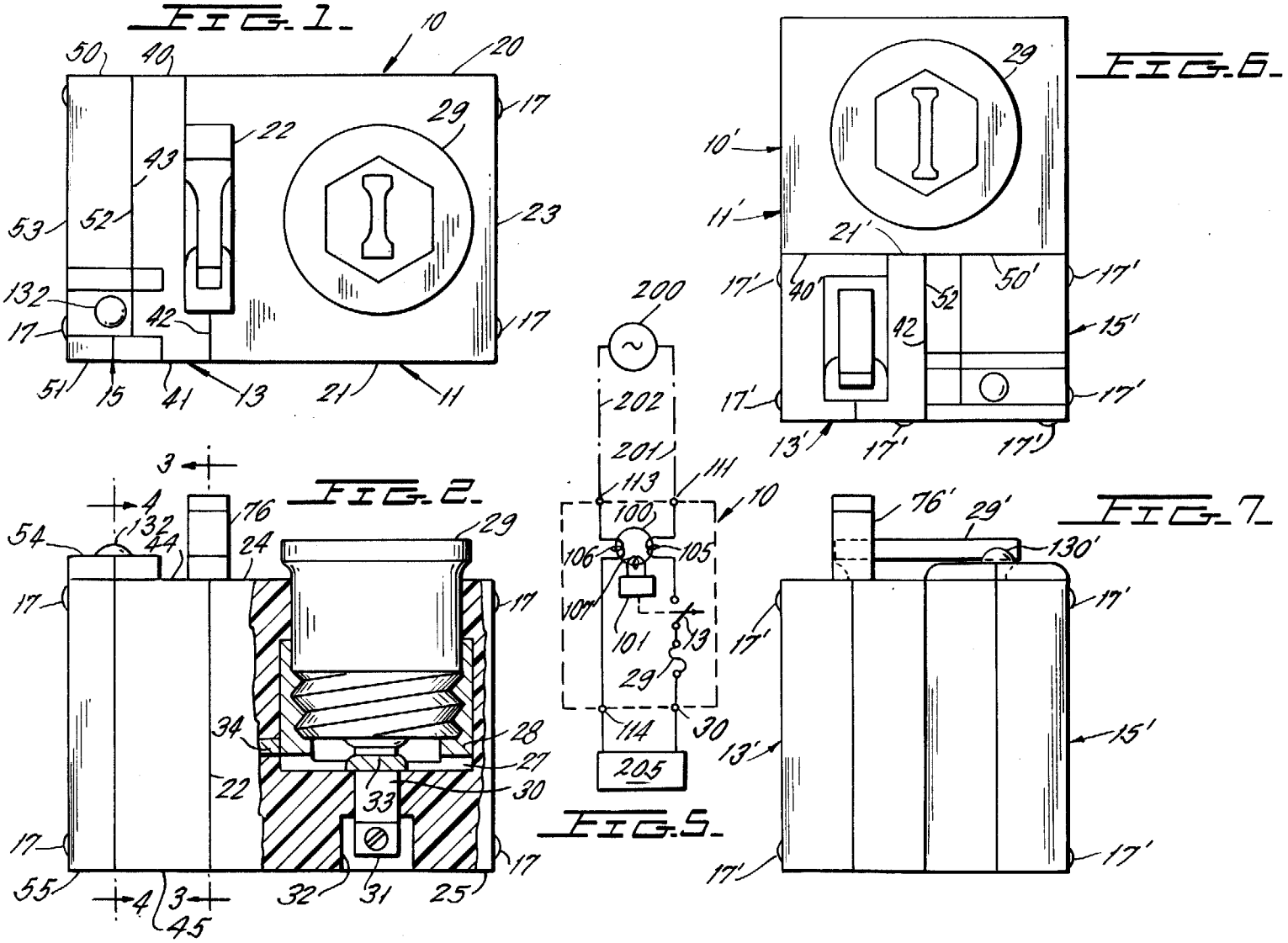
FIG. 1 is a plan view of one embodiment of a fused GFI unit constructed in accordance with the instant invention.
FIG. 2 is a partially-sectioned side elevation of the embodiment in FIG. 1.
FIG. 5 is a schematic showing the unit of FIG. 1 connected in circuit with a source of electrical energy and a utilization device.
FIG. 6 is a plan view of a second embodiment of a fused GFI unit in accordance with the instant invention.
FIG. 7 is an end view of the embodiment of FIG. 6.

Referring initially to FIGS. 1 and 2, a single phase unitized fuse GFI device 10 is shown. The device is encased in a molded housing of a rigid insulating material, preferably a plastic. The housing includes fuse receptacle section 11, complementary mechanical switch means section 13 and complementary ground fault interrupter section 15. The housing sections are held together by a plurality of rivets 17.

Molded fuse receptacle means section 11 thus includes a first pair of opposed top and bottom walls 20, 21, respectively; a pair of opposed first and second sidewalls 22, 23, respectively; and a second pair of opposed front and rear walls 24, 25, respectively. Fuse receptacle means 27 is molded within the insulating housing a sufficient distance below front wall 24 so that corrugated annular contact surface 28 cannot be contacted by personnel when fuse 29 is threadably engaged within fuse receptacle contact means 28. A short length of conductor 30 connects external load terminal 31, mounted in recess 32 in rear wall 25, to the center contact portion 33 of fuse receptacle means 27. A second conductor 34 extends from the threaded outer contact surface 28 through first sidewall 22 in a plane parallel to rear wall 25 for a purpose which will be hereinafter described. The second sidewall 22 includes a second plurality of recesses for receiving and locating the various operating components of switch means section 13.

Molded switch means section 13 includes a third pair of opposed top and bottom walls 40, 41 respectively; a pair of opposed third and fourth sidewalls 42, 43 respectively; and a fourth pair of opposed front and rear walls 44, 45 respectively. The third sidewall 42 includes a third plurality of recesses for receiving and locating the various operating components of the mechanical switch means 13 in cooperation with the second plurality of recesses formed in the first sidewall 22 of the fuse receptacle means section 11 as above described.

Molded ground fault detection section 15 includes a fifth pair of opposed top and bottom walls 50, 51 respectively; a pair of opposed fifth and sixth sidewalls 52, 53 respectively; and a sixth pair of opposed front and rear walls 54, 55 respectively. The fourth and fifth sidewalls 43, 52 include a correlated pair of slotted openings 58—58 through which ground fault actuating means extension 130 can cooperate with the switch mechanism as hereinafter described.

Referring now to all of the drawings, fuse receptacle section 11 includes an external load terminal 31, to which one line from a utilization device is connected in the conventional manner. This terminal is shown as a bolt-type terminal; however, it should be understood that any proper wire terminal may alternatively be employed. Auxiliary terminal 60 is provided in a recess 61 in top wall 40 of switch means 13 for connection to GFI means 15 as hereinafter described.

First and third sidewalls 22, 42 include first and second pluralities of recesses for receiving and locating the various operating components of the switch. Located within these recesses is a stationary contact 62, which is connected to fuse receptacle shell 28 via conductive member 34. Cooperating with stationary contact 62 is a movable contact 64 mounted to the lower end of a bifurcated contact arm 65. Parallel plate arc extinguishing means 66 is provided within recesses 67. The upper bifurcated end 68 of contact arm 65 abuts a suitable formation 69 of internally extending portion 70 of manual operating member 72. Manual operating member 72 is pivoted about protrusion 74 entered into suitable aligned recesses of the first sidewall 22 and the third sidewall 42. The manual operating member includes an outwardly extending portion operating handle 76 for manually moving circuit breaker 13 between its manual OFF and manual ON positions. Contact carrying arm 65 has a braid member 77 secured thereto, with the opposite end of the braid 78 connected to terminal 60.

Figure 3:
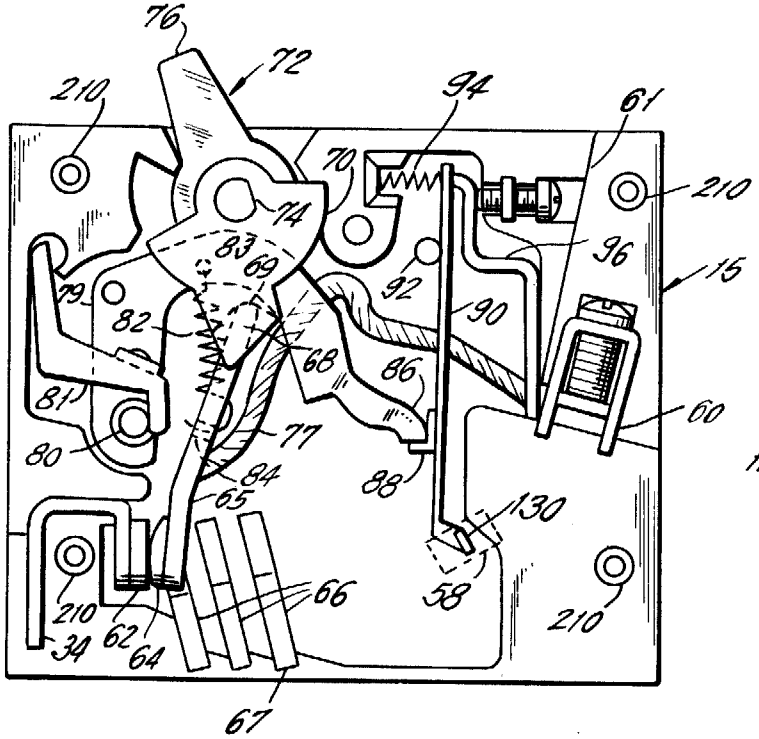
FIG. 3 is a side view of the unit with the fuse receptacle means portion removed, taken along the line 3—3 of FIG. 2.

The operating mechanism for bringing about the engagement and disengagement of cooperating contacts 62, 64 comprises a latchable cradle member 79, which is pivotally mounted at one end thereof, to sidewall protrusion 80. Cradle 79 also carries a kicker 81, which gives contact arm 65 a hammerlike blow during the separating operation to ensure proper separation of the circuit breaker contacts. One end of an operating spring 82 is connected to cradle 79 at aperture 83, while the other end of the operating spring 82 is connected to contact arm 65, at aperture 84. Operating spring 82 is always in tension, thereby urging contact arm end 68 upwardly into engagement with its pivotal mounting in manual operating member 70 and latchable cradle member 79 clockwise about its pivotal mounting 80. The force of operating spring 82 relative to the pivotal mounting of contact arm 65 also serves to urge the movable contact 64 into firm engagement with its cooperating stationary contact 62, as shown in FIG. 3.

Latchable cradle member 79 includes a latchable tip 86 which seats upon latch portion 88 carried by the lower region of elongated member 90. A transverse bearing pin 92 is suitably secured to an upper intermediate region of elongated member 90, as by welding, and enters suitable circular recesses (not shown) in the first and third sidewalls 22, 42 for pivotally mounting the elongated element 90. The latter is biased in a clockwise direction with respect to FIG. 5 or 3 about its pivot 92 by spring 94. Adjustment of the latch 88 is obtained by calibrating screw 95 which bears against intermediate member 96 which engages the upper end of pivoted latch support member 90.

Figure 4:
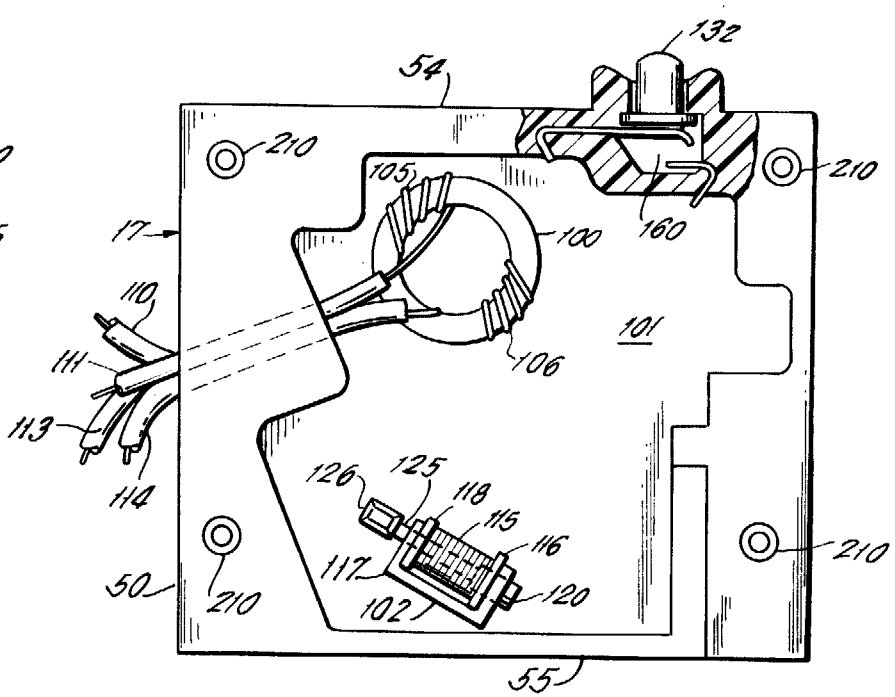
FIG. 4 is a partially-sectioned simplified side view of the ground fault detector portion of the unit, taken along line 4—4 of FIG. 2.

Protector section 15 contains ground fault detection means including differential transformer 100, circuit board 101, and electromagnetic operator 102. Differential transformer 100 includes identical primary windings 105, 106 of relatively few turns and secondary winding 107 (not shown in FIG. 4 for simplicity) having many more turns than either of the primary windings 105, 106. The four leads from primary windings 105, 106 are brought through end wall 50 of protection section 15 and extend freely therefrom. One lead of winding 105 is connected to auxiliary terminal 60. The ends of secondary winding 107 are connected to circuit board 101 which contains elements (not shown) for amplifying signals fed thereto to produce a control signal across winding 115 of electromagnetic operator 102. Magnet operating winding 115 is wound about core 116 and extends between stationary pole pieces 117 and 118. Rodlike cylindrical armature 120 extends axially through the center of energizing winding 115 and is axially movable toward the center of actuator 102 upon energization of winding 115. The end of armature 120 enclosed in winding 115 in the nonenergized position is provided with axial extension 125 having radially offset actuating member 126 at the free end thereof. Actuating member 126 extends through slotted openings 58—58 into switch section 13 and is positioned in close proximity to actuating portion 130 at the lowermost end of elongated member 90. Each of slotted openings 58—58 is slightly wider than the width of actuating member 126 in a direction transverse to the axis of extension 125 so that the aligned slots guide movement of member 126 when winding 115 is energized. When a ground fault of sufficient magnitude is detected in protection section 15, electromagnet 102 is actuated to move its armature 120 axially into the center of winding 115 with radially offset actuating member 126 engaging actuating portion 130 and moving elongated member 90 counterclockwise about pivot 92 to release cradle latch 88, thereby bringing about separation of switch contacts 62, 64.

Ground fault detection section 15 also includes normally open test switch 160 having an operating pushbutton 132 extending through top wall 54. The closing of test switch 160 is effective to create an unbalanced condition in transformer 100 of sufficient magnitude to cause actuation of electromagnet 102, thereby separating switch contacts 62, 64 as discussed above.

Referring now especially to FIG. 5, source of electrical energy 200 is connected by a pair of power carrying lines 201, 202 to fused GFI unit 10. One power carrying line 201 is connected to the remaining lead 111 of one primary winding 105. The other power carrying line 202 is connected to the appropriately marked input lead 113 of the differential transformer second primary winding 106. The remaining lead 114 from second primary winding 106 is connected to one terminal of power utilization device 205, whose other terminal is connected by suitable cable to external load terminal 30 of fused GFI unit 10. Thus, it should be understood that a series circuit is formed from power source 200 through the first primary 105 of differential transformer 100, switch means 13, fuse 29 and external load terminal 30 to power utilization device 205 and thence through the second primary winding 106 to return current to energy source 200.

In the event of an overcurrent hazard being present in utilization device 205 or the pair of power lines thereto from fused GFI unit 10, fuse 29 will form an open circuit and prevent continued current flow, thereby protecting the utilization device and the aforementioned lines. In the event of a high impedance fault to earth-ground greater than a predetermined magnitude, between external load terminal 30 and second lead 114 of second primary winding 106, ground fault protection circuitry 101 will energize winding 115 causing actuating member 126 to engage latch portion 130 and pivot elongated member 90 in a counterclockwise direction to release the free end 86 of cradle member 79, thereby causing separation of contacts 62, 64 and movement of manual operating member 72 to its OFF position.

In the embodiment of fused GFI unit 10 illustrated in FIGS. 1 and 2, fuse receptacle section 11, switch section 13 and ground fault detection section 15 are maintained in side-by-side relationship by a third plurality of recess-abutment pairs 210, formed in molded cooperating second, third, fourth and fifthe sidewalls 22, 42, 43 and 52, and further secured together by a fourth plurality of rivets 17.

A second embodiment of fused GFI unit 10', illustrated in FIGS. 6 and 7, includes fuse receptacle section 11', switch section 13' and ground fault detection section 15'. Switch section 13' is maintained by side-by-side relationship to ground fault detection section 15' by a fifth plurality of cooperating recess-abutment pairs formed in third and fifth sidewalls 42', 52' respectively. Switch section 13' and ground fault detection section 15' are maintained in over-and-under relationship to fuse section bottom wall 21' by a sixth plurality of cooperating recessabutment pairs formed in the switch section and ground fault detection section topwalls 40', 50' respectively, and in the fuse section bottom wall 21'. All three sections are secured together by a seventh plurality of rivets 17'. This embodiment is particulary suitable for installation in existing substantially-square-cross-section electrical conduit boxes as a replacement for units solely containing a manual switch without overcurrent or ground fault protection means.

There has just been described a novel sectionalized molded case fused GFI device for controlling the application of power to a utilization device while protecting that utilization device against overcurrent hazards and protecting personnel against shock hazards therefrom.

The present invention has been described in connection with a preferred embodiment thereof; many variations and modification will become apparent to those skilled in the art. Therefore, this invention is to be limited, not by the specific disclosure herein, but only by the appended claims.

The embodiments of the invention in which an exclusive privilege or property is claimed are:

1. A unitary fused ground fault circuit interrupting device constituting a protective arrangement for automatically interrupting a flow of current from a source of electrical energy to an external power utilization device upon the occurrence of predetermined fault conditions; said protective arrangement including:

a series combination of holding means for replaceably receiving a fuse, switch means actuated solely by mechanical operation and ground fault interruption means;

a fuse operatively mounted by said holding means and having a predetermined current interruption value, thereby to interrupt a flow of current from said source to said utilization device in the event of a current flow in excess of said interruption value;

said switch means including a pair of cooperating separable contacts, manually operable latchable means for moving said contacts between their engaged and disengaged positions, said latchable means when mechanically unlatched automatically moving said contacts to their disengaged position;

said ground fault interruption means including differential means for detecting a ground fault condition and an actuatable member, said actuatable member being operatively positioned to mechanically unlatch said latchable means to automatically move said contacts to their disengaged position in response to the detection by said differential means of a predetermined ground fault condition.

2. A device as set forth in claim 1, wherein said latchable means includes a latch means that is unlatchable solely by said actuatable member.

3. A device as set forth in claim 1, wherein said differential detection means monitors a pair of lines from an electrical energy source to a utilization device to detect a difference between the magnitude of the current flowing in each of said pair of lines, said detected magnitude difference enabling the movement of said actuatable member in the event said detected current magnitude difference exceeds a predetermined ground fault value.

4. A device as set forth in claim 3, wherein said actuatable member comprises a solenoid having a movable armature with an extension operatively engageable with said latchable means for unlatching thereof.

5. A device as set forth in claim 4, in which movement of said armature is linear and in a direction along an axis of said solenoid; and said extension of said armature moves in a direction transverse to the direction of the movement of said armature, said extension contacting and enabling said latchable means.

* * * * *